US007096652B2

(12) United States Patent
Kirkpatrick et al.

(10) Patent No.: US 7,096,652 B2
(45) Date of Patent: Aug. 29, 2006

(54) RIDING PAD FOR TWO PERSONS

(76) Inventors: Milinda Hendrick Kirkpatrick, 328 Whippoorwill La., Mount Holly, NC (US) 28120; Christine Ann Cronin, 4850 Thunderbolt Rd., Concord, NC (US) 28025

( * ) Notice: Subject to any disclaimer, the term of this patent is extended or adjusted under 35 U.S.C. 154(b) by 0 days.

(21) Appl. No.: 10/876,401

(22) Filed: Jun. 25, 2004

(65) Prior Publication Data

US 2005/0011168 A1 Jan. 20, 2005

(51) Int. Cl.
*B68C 1/02* (2006.01)

(52) U.S. Cl. ..... 54/44.1; 54/44.2

(58) Field of Classification Search ..... 54/44.1, 54/44.2, 44.5, 44.7, 66
See application file for complete search history.

(56) References Cited

U.S. PATENT DOCUMENTS 2,111,895 A * 3/1938 Krausse ..... 54/46.1
3,112,592 A * 12/1963 Schindler ..... 54/44.2
3,312,040 A * 4/1967 Nuzzo ..... 54/44.5
3,323,286 A * 6/1967 Le Laurin, Jr. ..... 54/44.5
4,324,090 A * 4/1982 Nix ..... 54/44.5
4,362,003 A * 12/1982 Robinson ..... 54/44.1
4,716,715 A * 1/1988 Johnson ..... 54/44.5
5,018,340 A * 5/1991 Marshall ..... 54/44.7
5,187,924 A * 2/1993 Marshall ..... 54/44.5
5,809,753 A 9/1998 Carney ..... 54/44.1

* cited by examiner

*Primary Examiner*—Robert P. Swiatek
(74) *Attorney, Agent, or Firm*—Michael L. Leetzow, P.A.

(57) ABSTRACT

A treeless riding pad has a first and second seating portion for two persons, and is particularly for use with handicapped and physically challenged riders. The riding pad allows a therapist or other professional to ride behind the rider and assist with therapy. The riding pad is made of soft materials and is typically an English-style pad. A looped member at the front of the riding pad allows the first rider to bold on to the animal. The riding pad has two sets of stirrups, allowing both riders to be stable while on the animal.

7 Claims, 4 Drawing Sheets

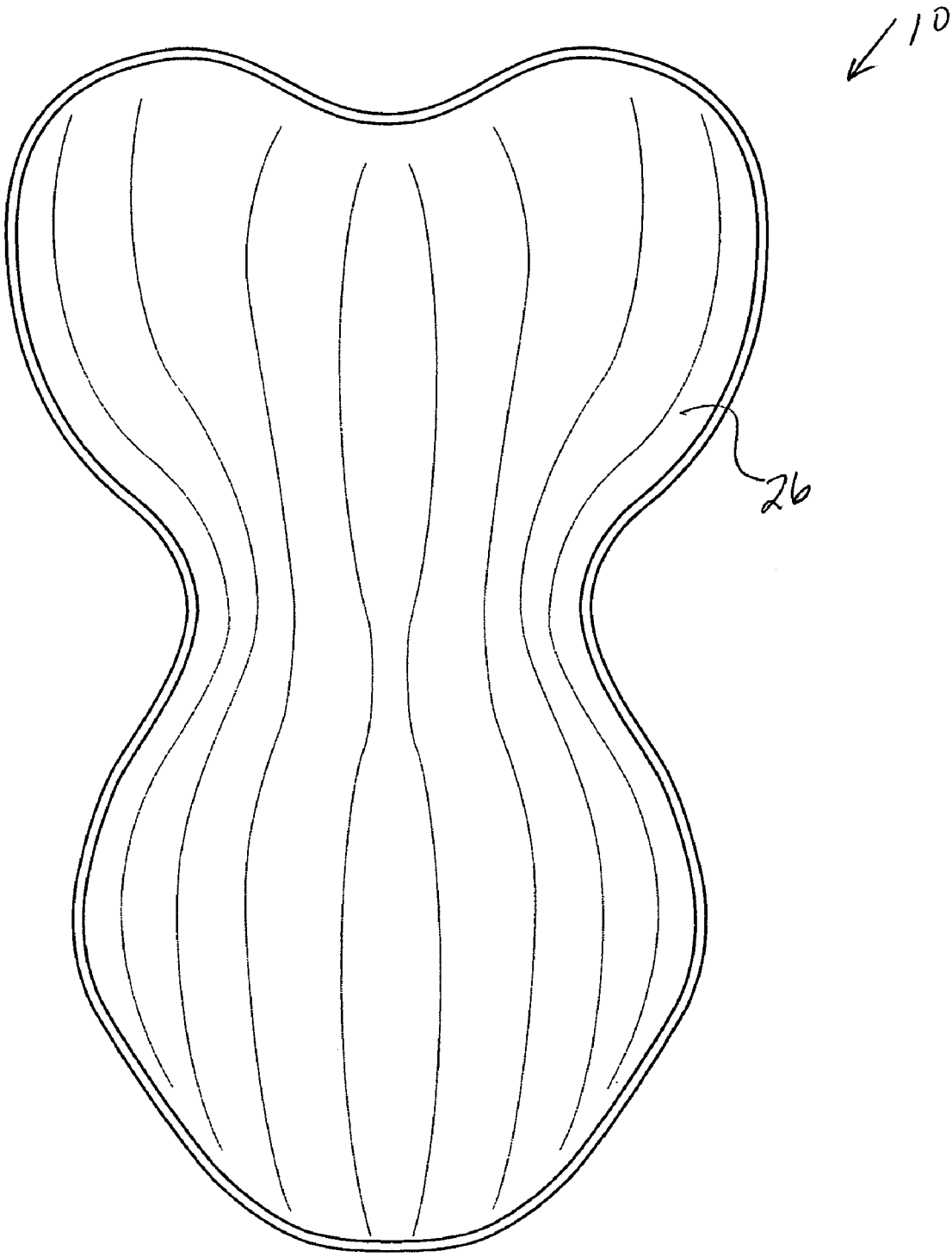
*Fig.* 4

RIDING PAD FOR TWO PERSONS

The present invention relates to a riding pad for two persons to ride an animal, and more particularly, a treeless riding pad with two sets of stirrups, one for each of the riders.

There are a number of prior art riding pads and saddles. However, only one two-person saddle that is known to be available and it suffers from the same issues as the one person saddles. Saddles have a tree or a rigid support included under the leather or other materials and provides support to the rider. However, when used with handicapped or physically challenged riders, those saddles are not appropriate. First they may provide support in the wrong places and not provide any support in the correct areas. Further, they are very heavy and, due to weight limitations for the animals, do not allow for a second rider. Even if a second rider could safely ride (due to weight limitations) with a typical saddle, there is no support for the second rider since the saddles only have one set of stirrups. Additionally, the back part of the saddle and cantle are typically in the way of the second rider, making the riding time uncomfortable or even dangerous, if the first rider were to need assistance. These saddles also position the riders quite a distance from the animal, preventing the animal's warmth from penetrating the saddle.

Accordingly, the present invention is directed to a riding pad that substantially obviates one or more of the problems and disadvantages in the prior art. Additional features and advantages of the invention will be set forth in the description that follows, and in part will be apparent from the description, or may be learned by practice of the invention. The objectives and other advantages of the invention will be realized and attained by the apparatus and process particularly pointed out in the written description and claims, as well as the appended drawings.

SUMMARY OF THE INVENTION

To achieve these and other advantages and in accordance with the purpose of the invention as embodied and broadly described herein, the invention is directed to an English-style, treeless riding pad for two persons, the riding pad including a first seat portion for a first person, a second seat portion for a second person, the second seat portion disposed behind the first portion, a first and second stirrup attachment member, the first stirrup attachment member adjacent the first seat portion and the second stirrup attachment member adjacent the second seat portion, and a looped member adjacent a front edge of the riding pad for first person to hold onto while on the riding pad.

In yet another aspect, the present invention is also directed to an English-style, treeless riding pad for two persons, the riding pad including a first seat portion for a first person, a second seat portion for a second person, the second seat portion disposed behind the first portion, and a looped member adjacent a front edge of the riding pad for first person to hold onto while on the riding pad.

It is to be understood that the foregoing general description and the following detailed description are exemplary and explanatory and are intended to provide further explanation of the invention as claimed.

The accompanying drawings are included to provide a further understanding of the invention and are incorporated in and constitute a part of the specification. The drawings illustrate several embodiments of the invention and together with the description serve to explain the principles of the invention.

BRIEF DESCRIPTION OF THE DRAWINGS

FIG. 4 is a bottom view of the riding pad of FIG. 1 with the stirrups and rigging removed for clarity.

DETAILED DESCRIPTION OF THE INVENTION

Figure 1:
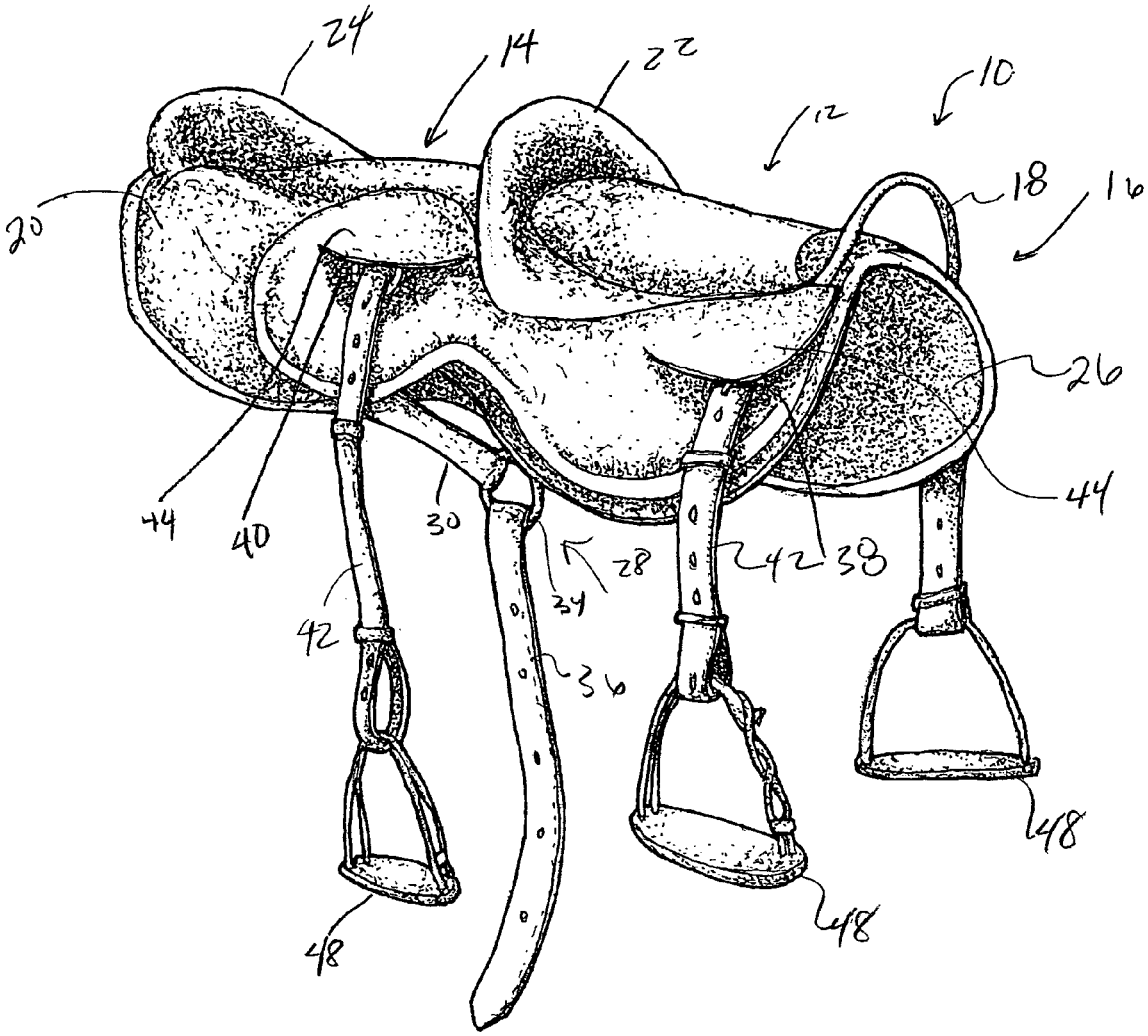
FIG. 1 is a perspective view of one embodiment of a riding pad according to the present invention.
Figure 2:
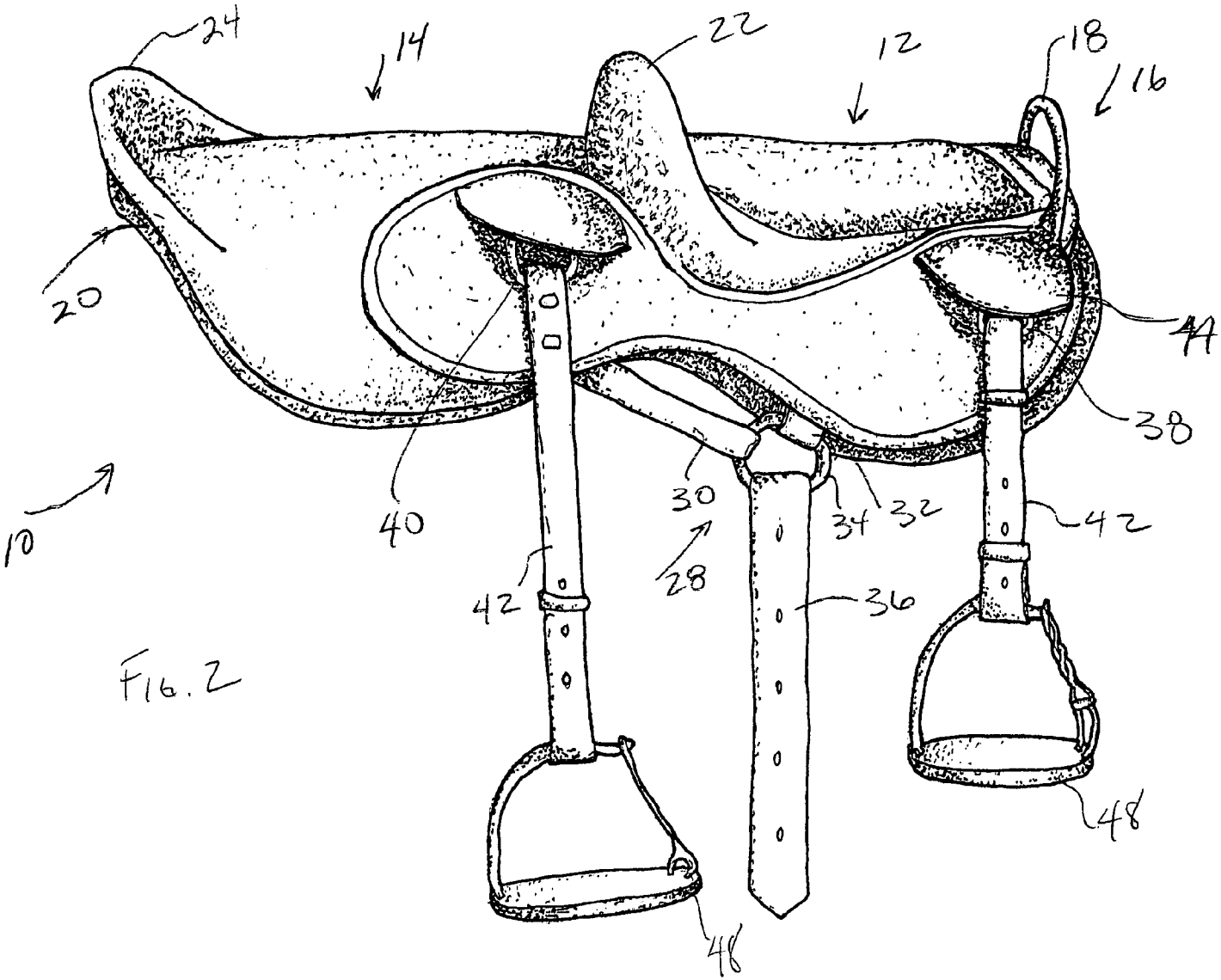
FIG. 2 is right side view of the riding pad of FIG. 1.

A riding pad 10 according to the present invention is illustrated in FIG. 1. The riding pad 10 is preferably an English-style riding pad, however the principles of the invention may be applied to other styles as well. The riding pad 10 is also preferably treeless, that is, it has no tree or other structural element contained with in the pad. The riding pad 10 is configured for two riders, a first rider and a second rider (not illustrated). As indicated above, the riding pad 10 is preferably for two riders. While riding pad 10 was originally designed for use with the handicapped or physically challenged, it could be used in any situation where two riders would be on the same animal. For example, the riding pad 10 could be used when one person wants to teach a child how to ride a horse. The riding pad 10 may also be used with vaulting pairs, i.e., trick riding involving two persons on a horse. Naturally, the pad could also be used in any instance where two persons would be on the animal.

In riding pad 10, the first rider would occupy the first seat position 12 and the second rider would occupy the second seat position 14, if there were a second person riding with the first person. It should be noted that typically the riding pad 10 will be used with a horse or other equestrian animal, but it could be used with any animal that is suitable for riding.

The first seat portion 12 is disposed at the front 16 of the riding pad 10 and preferably has a looped element 18 for the rider to grasp. The looped element 18 is preferably made of leather, but could be made of any other soft, durable material. It is preferred that the riders have only soft elements around them so that if there were to lean or fall forward, they would not injure themselves on any portion of the pad. Similarly, the majority of the top side 20 of the riding pad 12 is also made of leather. However, it is envisioned that the top side 20 could be made of any appropriate materials, including synthetic ones.

The first seat portion 12 preferably has a cantle-like ridge element 22 to provide a limited amount of support to the first rider. The ridge element 22 is preferably rounded in shape as it crosses the riding pad 10 to correspond to the anatomy of the rider when that person sits in the first seat portion 12. The ridge element 22 is preferably made of leather and may have soft materials (e.g., felt, fleece, leather, etc.) encapsulated to provide some structure and stability to it. Similarly, the second seat portion 14 also has a ridge element 24 similar to the ridge element 22 for the same purpose. The ridge element 22 is typically lower than most cantles on saddles with trees. The lower the ridge element 22, the less support and more work the rider may have to do. This provides a good opportunity for the rider to develop strength in areas that the rider may not otherwise be able to.

The underside 26 of the riding pad 10 is preferably made of felt. The felt 26 is preferably attached directly to the leather of the top side 20, to provide a relatively thin riding pad 10. It should be noted that the leather for the top side 20 and the felt 26 may be of a variety of thicknesses. Another layer of soft, flexible material may also be included between the leather and the felt layers. However, it is preferable that the layers are thin enough to allow the heat from the animal to be transmitted through the riding pad 10 and provide warmth to the riders. The warmth from the animals assists with circulation in the riders. With the felt 26, the riding pad need not have another pad between it and the animal. Rather, the felt provides all of the protection that the animal needs. It is possible, however, to put another pad between the riding pad 10 and the animal.

The riding pad 10 preferably has a three quarter rigging 28 on both sides of the riding pad 10 to assist with securing the riding pad to the animal. While any rigging is acceptable (e.g., full, center, ⅞, etc.), Applicants have found that the three quarter rigging is preferred. The preferred rigging 28 consists of two straps 30,32 attached to the riding pad and then to a ring 34. The strap 30 is preferably attached in front of a ring 34 and strap 32 is preferably attached to the pad 10 behind the ring 34. The actual distance between the attachment points of the straps 30,32 is not critical. It is also preferred that the riding pad 10 have billets 36 attached to the rings 34 on either side, rather than the typical latigo, which then in turn attach to a cinch (not shown). Applicants have found that the billets 36 attached on either side to the rings 34 provide better opportunities for the pad to be secured when both riders are on the animal and do not interfere with the riders.

Figure 3:
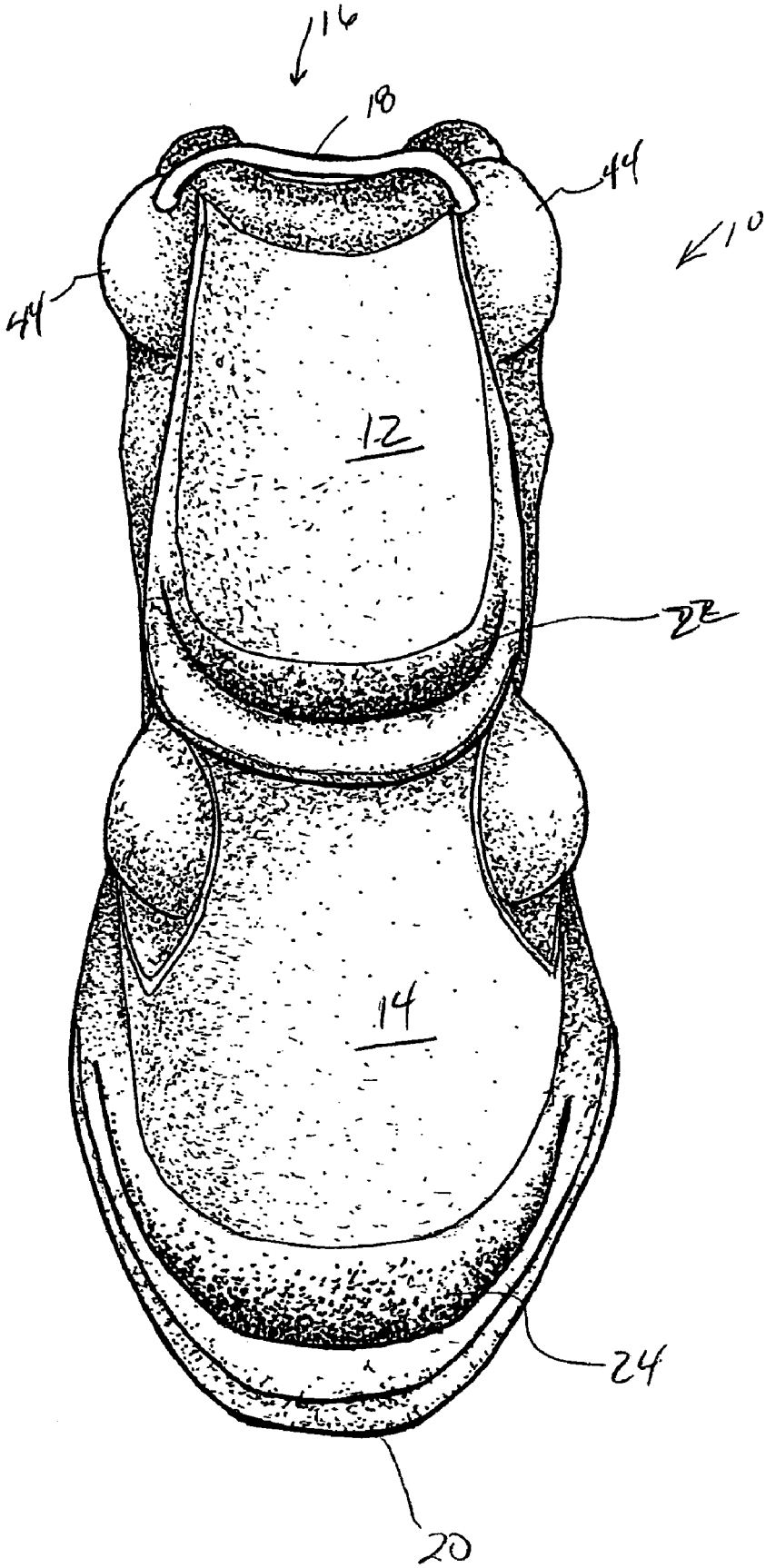
FIG. 3 is a top view of the riding pad of FIG. 1.

The riding pad 10 also has a two attachment 38,40 elements on each side of the riding pad 10 for the stirrups for the first and second seat portions 12,14. The attachment elements 38,40 are preferably metal rings to which the stirrup leathers 42 would attach. Each of the attachment elements 38,40 also have a skirt 44 covering the attachment elements 38,40 so that the riders do not get caught or injured on them. While a particular design of stirrups 48 is illustrated, the riding pad 10 may have any design of stirrups and still be within the scope of the present invention. The attachment elements 38,40 are more forward of their respective seat portions 12,14 than on a typical saddle. Usually, the attachment elements are relatively close to the center of the seat portion between the skirt and fender, whereas the attachment elements 38,40 in the present application are generally in a forward part of the seat portion. See, e.g., FIG. 3. This allows the riders to more fully develop and use their legs while riding. Many of the riders that use the riding pad 10 are fully ambulatory and therefore, the use of the legs while on the animal may be some of the other exercise that their legs receive. The position of the attachment elements 38,40 also allows for stretching and flexibility exercises while mounted on the animal without the attachment elements 38,40 interfering with those exercises.

The length of the riding pad 10, while allowing sufficient distance between the first and second seat portions 12,14 for the first rider to be more independent and develop riding skills, is still not so long as to injure the animal's back or kidneys. Applicants note that the size of the riding pad 10 and the seat portions 12,14 may vary depending on the age, weight, and height of the riders, however, the configuration of the first and second seat portions allows It will be apparent to those skilled in the art that various modifications and variations can be made in the water heater controller of the present invention without departing from the spirit or scope of the invention. Thus, it is intended that the present invention cover the modifications and variations of this invention provided they come within the scope of the appended claims and their equivalents.

We claim:

1. An English-style, treeless riding pad for two persons, the riding pad comprising:

a first seat portion for a first person, the first seat portion having a ridge element at a rear portion of the first seat portion;

a second seat portion for a second person, the second seat portion disposed behind the first portion and having a ridge element at a rear portion of the second seat portion;

a first and second stirrup attachment member, the first stirrup attachment member adjacent the first seat portion and the second stirrup attachment member adjacent the second seat portion; and a looped member adjacent a front edge of the riding pad for first person to hold onto while on the riding pad.

2. The English-style, treeless riding pad according to claim 1, wherein the first stirrup attachment member is generally forward of the first seat portion; and the second stirrup attachment member is generally forward of the second seat portion and behind the first seat portion.

3. The English-style, treeless riding pad according to claim 1, wherein materials used for the riding pad are comprised essentially of soft materials.

4. The English-style, treeless riding pad according to claim 3, wherein the soft materials are selected from die group of materials including leather, felt, suede, and fleece.

5. The English-style, treeless riding pad according to claim 1, further comprising:

a rigging on each side of the riding pad for securing the riding pad to an animal, the rigging comprising a first and a second strap, the first strap attached to the riding pad adjacent the first seat portion, and the second strap attached to the riding pad adjacent the second seat portion and behind the first seat portion; and a billet attached to the rigging on each side of the riding pad.

6. The English-style, treeless riding pad according to claim 1, wherein the first seat portion is configured for a person who is smaller than a person for the second seat portion.

7. An English-style, treeless riding pad for two persons, the riding pad comprising:

a first seat portion for a first person, the first seat portion having a ridge element at a rear portion of the first seat portion;

a second seat portion for a second person, the second seat portion disposed behind the first portion and having a ridge element at a rear portion of the second seat portion;

a first and second stirrup attachment member, wherein the first stirrup attachment member is adjacent the first seat portion and the second stirrup attachment member is adjacent the second seat portion and behind the first seat portion;

a rigging on each side of the riding pad for securing the riding pad to an animal, the rigging comprising a first and a second strap, the first strap attached to the riding pad adjacent the first seat portion, and the second strap attached to the riding pad adjacent the second seat portion and behind the first seat portion; and a looped n,ember adjacent a front edge of the riding pad for first person to hold onto while on the riding pad.

* * * * *

UNITED STATES PATENT AND TRADEMARK OFFICE

CERTIFICATE OF CORRECTION

PATENT NO. : 7,096,652 B2
APPLICATION NO. : 10/876401
DATED : August 29, 2006
INVENTOR(S) : Milinda H. Kirkpatrick and Christine A. Cronin It is certified that error appears in the above-identified patent and that said Letters Patent is hereby corrected as shown below:

Column 4,
Line 64, “n,ember” should be changed to --member--.

Signed and Sealed this

Thirty-first Day of October, 2006

JON W. DUDAS
*Director of the United States Patent and Trademark Office*